US010718533B2

(12) United States Patent
Kim et al.

(10) Patent No.: US 10,718,533 B2
(45) Date of Patent: Jul. 21, 2020

(54) FAN ASSEMBLY AND AIR CONDITIONER HAVING THE SAME

(71) Applicant: Samsung Electronics Co., Ltd, Gyeonggi-do (KR)

(72) Inventors: Jin Baek Kim, Gyeonggi-do (KR); Hyun Joo Jeon, Gyeonggi-do (KR); Eung Ryeol Seo, Gyeonggi-do (KR); Jun Kyu Jung, Seoul (KR); Dong Gi Han, Seoul (KR); Yong Hun Kang, Seoul (KR); Byung Woo Jeon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 844 days.

(21) Appl. No.: 15/094,840

(22) Filed: Apr. 8, 2016

(65) Prior Publication Data

US 2016/0298636 A1 Oct. 13, 2016

(30) Foreign Application Priority Data

Apr. 8, 2015 (KR) ..... 10-2015-0049379

(51) Int. Cl.
*F24F 1/0033* (2019.01)
*F04D 19/00* (2006.01)

(52) U.S. Cl.
CPC ..... *F24F 1/0033* (2013.01); *F04D 19/007* (2013.01)

(58) Field of Classification Search
CPC ..... F24F 1/0033; F04D 19/007; F04D 25/166
USPC ..... 415/176, 60, 66; 416/120, 124, 125
See application file for complete search history.

(56) References Cited

U.S. PATENT DOCUMENTS 3,021,696 A * 2/1962 Spiegelinalter ..... F24F 1/02 416/124
6,945,758 B1 * 9/2005 Lievens ..... F04D 19/002 415/220
8,337,154 B2 * 12/2012 Decker ..... F04D 25/0606 415/191
8,647,077 B2 * 2/2014 Vinson ..... F04D 29/384 417/313
2003/0150326 A1 * 8/2003 Chasen ..... B01D 46/10 95/273
2004/0028522 A1 * 2/2004 Lin ..... F04D 25/166 415/66
2005/0186096 A1 8/2005 Vinson et al.
(Continued)

FOREIGN PATENT DOCUMENTS

CN 1971065 A 5/2007

OTHER PUBLICATIONS

National Intellectual Property Administration, PRC, "The First Office Office," Application No. CN201610213144.4, dated Jan. 9, 2019, 20 pages.

(Continued)

*Primary Examiner* — Woody A Lee, Jr.
*Assistant Examiner* — Michael L Sehn

(57) ABSTRACT

Provided herein are a fan assembly having improved cooling and heating performance and an air conditioner having the same. The fan assembly provided in an air conditioner includes a plurality of rotating fans provided to be rotatable about the same rotating shaft and at least one fixed fan fixed between adjacent two rotating fans of the plurality of rotating fans.

19 Claims, 13 Drawing Sheets

(56) References Cited

U.S. PATENT DOCUMENTS

2014/0072434 A1* 3/2014 Wu ..... F04D 17/162
416/198 R

OTHER PUBLICATIONS

Office Action dated Jul. 26, 2019 in connection with Chinese Patent Application No. 201610213144.4, 24 pages.

* cited by examiner

FAN ASSEMBLY AND AIR CONDITIONER HAVING THE SAME

CROSS-REFERENCE TO RELATED APPLICATION AND CLAIM OF PRIORITY

This application claims the benefit of Korean Patent Application No. 10-2015-0049379, filed on Apr. 8, 2015 in the Korean Intellectual Property Office, the disclosure of which is incorporated herein by reference.

FIELD

Embodiments relate to a fan assembly which has improved performance and an air conditioner having the same.

BACKGROUND

In general, an air conditioner is a device which maintains indoor air using a refrigeration cycle so as to be suitable for human activities. A conventional air conditioner may cool or heat air near a heat exchanger according to a phase change of a refrigerant flowing in the heat exchanger, and discharge the cooled or heated air to an indoor area, and thus an indoor temperature may be suitably maintained.

Such an air conditioner includes a refrigeration cycle in which a refrigerant circulates among a compressor, a condenser, an expansion valve, and an evaporator in a forward or backward direction, and the compressor provides the refrigerant having a high temperature and high pressure gas state and the condenser provides the refrigerant having a room temperature and high pressure liquid state. The expansion valve depressurizes the refrigerant having a room temperature and high pressure liquid state, and the evaporator evaporates the depressurized refrigerant into a low temperature gas state.

The air conditioner may be classified into a separated air conditioner in which an outdoor unit and an indoor unit are separately installed from each other, and an integrated air conditioner in which an outdoor unit and an indoor unit are integrally installed with each other.

SUMMARY

Therefore, it is an aspect to provide a fan assembly having an improved structure and an air conditioner having the same.

The improved fan structure may reduce pressure loss and increase wind speed of the fan.

In addition, the air conditioner may be formed to be compact.

Additional aspects will be set forth in part in the description which follows and, in part, will be obvious from the description, or may be learned by practice of the disclosure.

In accordance with one aspect, a fan assembly provided in an air conditioner includes a plurality of rotating fans provided to be rotatable about the same rotating shaft, and at least one fixed fan fixed between adjacent two rotating fans of the plurality of rotation fan.

The plurality of rotating fans may be provided to simultaneously rotate at a same speed.

The plurality of rotating fans may receive a driving force from a single fan motor.

An accommodation portion in which the fan motor is accommodated may be provided in the fixed fan.

The plurality of rotating fans may be capable of being controlled to be separately turned on or off.

The plurality of rotating fans may be capable of being controlled to rotate at speeds different from each other.

The plurality of rotating fans may respectively receive driving forces from fan motors that are separated provided from each other.

Each of the rotating fan and the fixed fan may include a fan frame and a plurality of blades which radially extend from the fan frame.

The fan assembly may further include a fan motor which drives the rotating fan, and the fan motor may be installed in the fan frame of the fixed fan.

A stagger angle of the blade provided in the rotating fan may be in a range of 10° to 80°.

A stagger angle of the blade provided in the fixed fan may be in a range of 10° to 50°.

An inlet angle of the blade provided in the fixed fan may be in a range of 10° to 50°.

The blade provided in the rotating fan or the fixed fan may be provided in an arc fan shape.

The blade provided in the rotating fan or the fixed fan may be provided in an airfoil fan shape.

A ratio D1/D2 of a diameter D1 of the fan frame provided in the rotating fan or the fixed fan to an entire diameter D2 of the rotating fan or the fixed fan may be in a range of 0.4 to 0.8.

The rotating fan may include a first rotating fan and a second rotating fan, and the fixed fan may include a first fixed fan and a second fixed fan.

The rotating fan and the fixed fan may be disposed in the order of the first rotating fan, the first fixed fan, the second rotating fan and the second fixed fan.

The first rotating fan may be positioned at a side of an air inlet portion, and the second fixed fan may be positioned at a side of an air outlet portion.

The rotating fan and the fixed fan may be disposed in the order of the first fixed fan, the second rotating fan, the second fixed fan, and the second rotating fan.

In accordance with another aspect, an air conditioner includes a housing which forms an exterior of an indoor unit and in which a discharge port is formed so that air that has exchanged heat with a refrigerant is discharged, and a fan assembly which is accommodated in the housing and blows air into an indoor area, wherein the fan assembly includes a plurality of rotating fans provided to be rotatable about a same rotating shaft and at least one fixed fan fixed between two adjacent rotating fans of the plurality of rotating fans.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
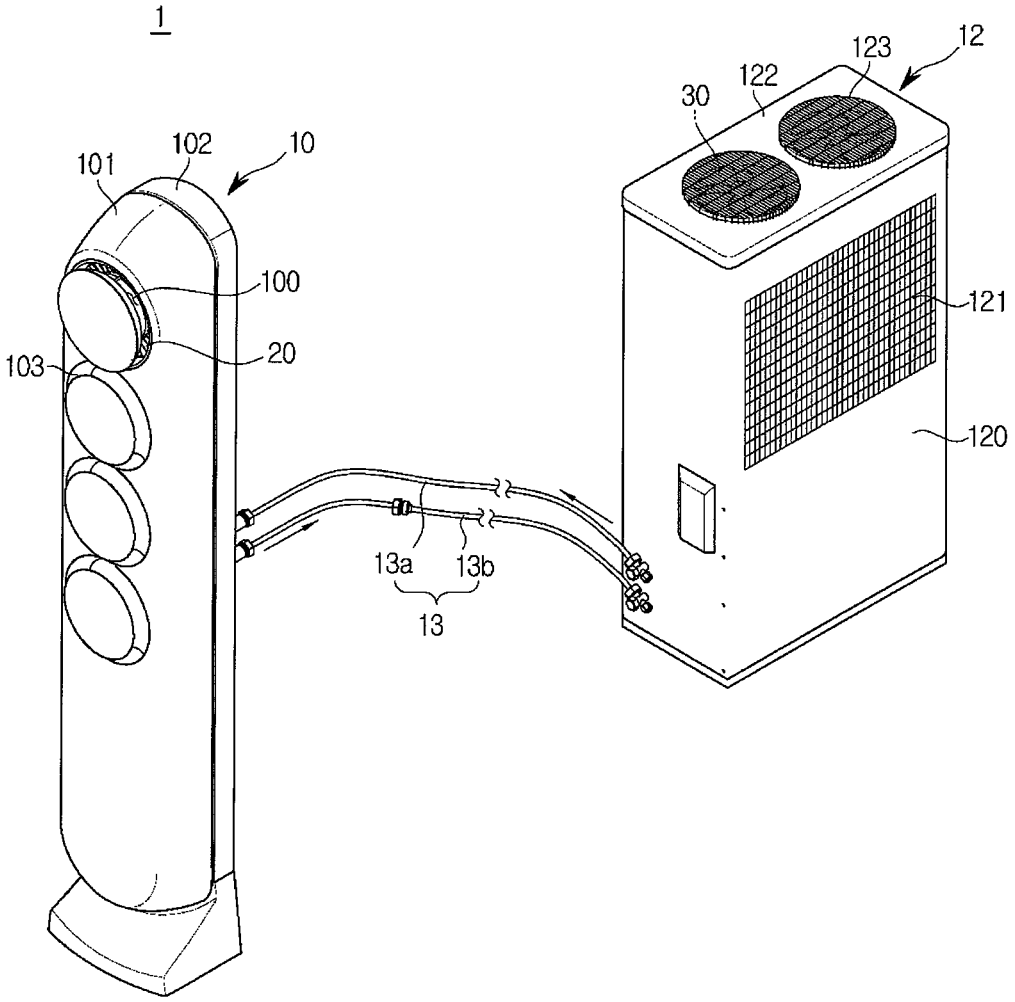
FIG. 1 is a view illustrating an air conditioner according to one embodiment.

Reference will now be made in detail to the embodiments, examples of which are illustrated in the accompanying drawings, wherein like reference numerals refer to like elements throughout.

Hereinafter, a fan assembly according to one aspect and an air conditioner having the same will be described in detail with reference to accompanying drawings.

FIG. 1 is a view illustrating an air conditioner according to one embodiment.

Referring to FIG. 1, an air conditioner 1 according to one embodiment includes an indoor unit 10 and an outdoor unit 12. The indoor unit 10 and the outdoor unit 12 may be connected to each other by a refrigerant pipe 13. Although the air conditioner 1 may be an air conditioner capable of cooling and heating, hereinafter, the following description will be made in relation to an air conditioner capable of cooling will be described.

The refrigerant pipe 13 may include a first refrigerant pipe 13*a* and a second refrigerant pipe 13*b*. A refrigerant condensed in the outdoor unit 12 may move to the indoor unit 10 through the first refrigerant pipe 13*a*. The refrigerant which exchanges heat with indoor air in the indoor unit 10 may move to the outdoor unit 12 through the second refrigerant pipe 13*b*. As described above, the refrigerant may circulate between a refrigerant pipe provided in the indoor unit 10 and a refrigerant pipe provided in the outdoor unit through the refrigerant pipe 13.

The indoor unit 10 may discharge air that has exchanged heat with a refrigerant compressed and condensed in the outdoor unit 12 into an indoor area to maintain a suitable temperature. The indoor unit 10 may include an expansion valve and an evaporator. As air cooled by a refrigerant evaporated in the evaporator is discharged into the indoor area, indoor air may be cooled. The indoor unit 10 may be provided with a fan assembly 20 configured to blow cooled air so that the air cooled by a refrigerant is smoothly discharged into the indoor area. The cooling performance may become better according to an increase of a volume of air of the fan assembly 20.

The indoor unit 10 includes housings 101, 102 forming an exterior of the indoor unit 10. The housings 101, 102 may include a front panel 101 and a rear panel 102. A discharge port 100 which discharges air blown from the fan assembly 20 may be formed at the front panel 101. A plurality of discharge ports 100 may be provided at the front panel 101. The discharge port 100 may be provided in a ring shape. Air blown by the fan assembly 20 may be discharged into the indoor area through the discharge port 100 formed at the front panel 101. The discharge port 100 may be provided to be capable of being opened and closed by a cover 103.

The rear panel 102 is coupled to a rear side of the front panel 101 to form a rear surface of the indoor unit 10. A suction port may be provided in the rear panel 102. Air which has been introduced through the suction port may be subject to heat exchange heat by a heat exchanger 110 (see FIG. 3) in the housing, blown by the fan assembly 20, and discharged into the indoor area through the discharge port 100 formed at the front panel 101.

The fan assembly 20 may be positioned at the rear side of the front panel 101. The fan assembly 20 disposed in front of the heat exchanger may blow air so that air exchanged heat in the heat exchanger is discharged through the discharge port 100.

The performance of the indoor unit 10 may be improved according to an increase of a volume of air blown by the fan assembly 20. Cooled air may reach a position far away from the indoor unit 10 according to an increase of the volume of air of the fan assembly 20, and a temperature of indoor air may decrease quickly.

The outdoor unit 12 may include housings 120, 122 forming an exterior thereof. The housings 120, 122 may include side panels 120 and an upper panel 122. A compressor, a condenser, and a blower fan 30 may be provided in the housings 120, 122. The compressor compresses a refrigerant, and the compressed refrigerant is introduced into the condenser and condensed. At this time, high temperature heat is generated in the compressor and the condenser.

An inlet port 121 may be formed in the outdoor unit 12, wherein external air may be introduced through the inlet port 121 to cool the compressor and the condenser provided in the outdoor unit 12. In addition, an outlet port 123 through which air that has exchanged heat with the compressor and the condenser is discharged may be formed in the outdoor unit 12. For example, the inlet port 121 may be formed in the side panel 120. The outlet port 123 may be formed in the upper panel 122. A fan assembly 30 may be provided at a side of the outlet port 123 and may blow air introduced through the inlet port 121 to be discharged through the outlet port 123.

A plurality of indoor units 10 may be connected to the outdoor unit 12. When the plurality of indoor units 10 are connected thereto, since an amount of a refrigerant to exchange heat increases, a greater amount of heat may be generated by the compressor and the condenser than when one indoor unit 10 is connected to the outdoor unit 12. A greater amount of air blown by the fan assembly 30 is needed to cool the heat of the compressor and the condenser which generate a greater amount of heat.

As described above, to improve the performance of the air conditioner 1, the performance of the fan assemblies 20, 30 needs to be improved so that a greater amount of air is blown. Enlarging the fan assemblies 20, 30 to increase the amount of air of the fan assemblies 20, 30 may cause difficulty in implementing the air conditioner 1 in a compact structure.

According to one aspect, the air conditioner 1 may be provided with the fan assemblies 20, 30 which are compact and have high performance. Therefore, the air conditioner 1 may be implemented in a high performance, high efficiency and a compact structure.

Figure 2:
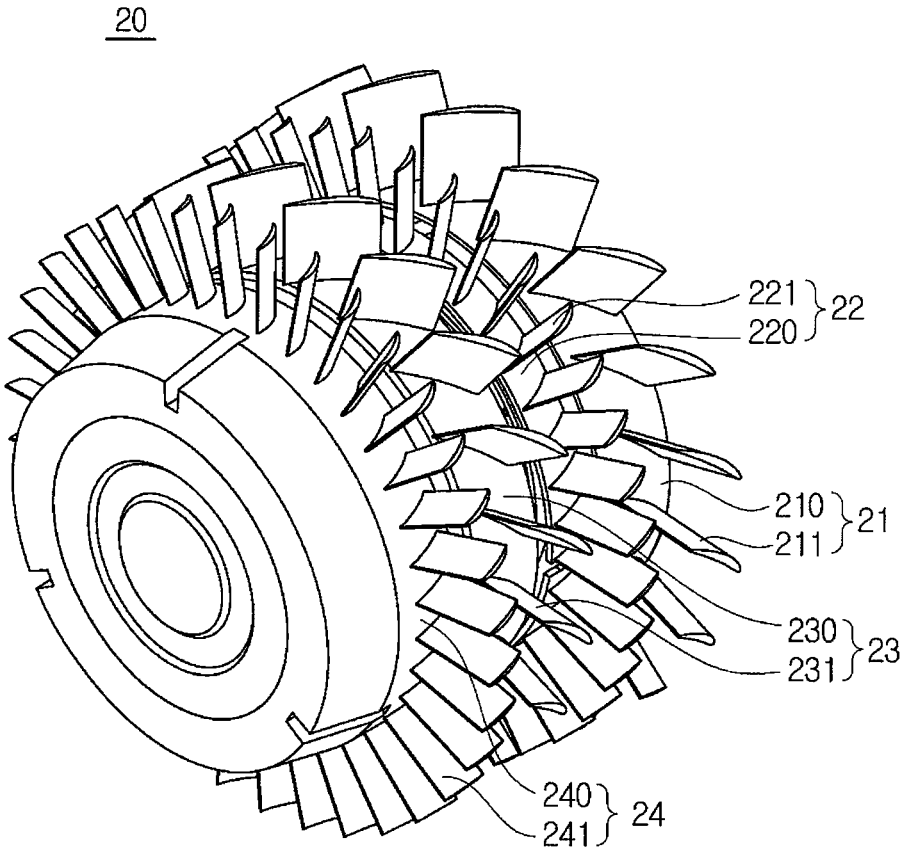
FIG. 2 is a perspective view illustrating a fan assembly of an indoor unit according to one embodiment.
Figure 3:
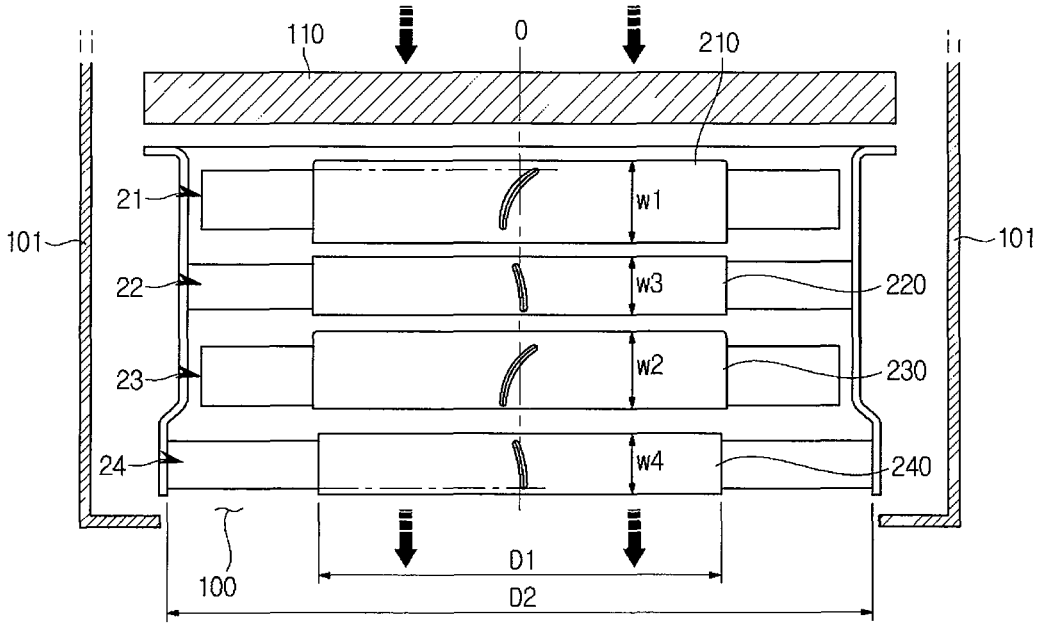
FIG. 3 is a schematic view illustrating the fan assembly according to one embodiment.

FIG. 2 is a perspective view illustrating a fan assembly of an indoor unit according to one embodiment, and FIG. 3 is a schematic view illustrating the fan assembly according to one embodiment.

Referring to FIGS. 2 and 3, the fan assembly 20 according to one embodiment may include a plurality of rotating fans and one or more fixed fans. The fixed fan is provided to be interposed between two adjacent rotating fans. The plurality of rotating fans are provided to rotate about the same rotating shaft. The rotating fan and the fixed fan may be positioned alternately. Hereinafter, an embodiment in which two rotating fans and two fixed fans are provided will be described.

The fan assembly 20 according to one embodiment may include a first rotating fan 21, a second rotating fan 23, a first fixed fan 22, and a second fixed fan 24. The first rotating fan 21 and the second rotating fan 23 may be rotatably provided using a fan motor. The first fixed fan 22 and the second fixed fan 24 may be fixed so as not to move.

The first fixed fan 22 may be positioned between the first rotating fan 21 and the second rotating fan 23. The first fixed fan 22 may be positioned in front of the first rotating fan 21, and the second rotating fan 23 may be positioned in front of the first fixed fan 22. The second fixed fan 24 may be positioned in front of the second rotating fan 23. Air which has passed through the heat exchanger 110 sequentially passes through the first rotating fan 21, the first fixed fan 22, the second rotating fan 23, and the second fixed fan 24, and then discharged into the indoor area through the discharge port 100.

The first rotating fan 21 and the second rotating fan 23 may be rotated by the fan motor to blow air which has passed through the heat exchanger 110. The first rotating fan 21 and the second rotating fan 23 may simultaneously rotate. When the first rotating fan 21 and the second rotating fan 23 simultaneously rotate, the rotational speed of the first rotating fan 21 and the rotational speed of the second rotating fan 23 may be suitably adjusted for efficient blowing. The rotational speed of the first rotating fan 21 and the rotational speed of the second rotating fan 23 may be the same or different from each other. Meanwhile, only one of the first rotating fan 21 or the second rotating fan 23 may rotate.

The first rotating fan 21 may include a fan frame 210 having a ring shape and a plurality of blades 211 radially disposed on the fan frame 210. Similarly, the second rotating fan 23 may include a fan frame 230 having a ring shape and a plurality of blades 231 radially disposed on the fan frame 230. Also, the first fixed fan 22 and the second fixed fan 24 may respectively include fan frames 220 and 240 having a ring shape and a plurality of blades 221 and 241 radially disposed on the fan frames 220 and 240. The blades 211, 221, 231, and 241 may be disposed corresponding to the discharge port 100 having a ring shape.

The fan frame 210 of the first rotating fan 21 and the fan frame 230 of the second rotating fan 23 may have the same diameter D1 as each other. The fan frame 220 of the first fixed fan 22 and the fan frame 240 of the second fixed fan 24 may also have the diameter D1 as each other.

A ratio (D1/D2) of the diameter D1 of the fan frame 210, 220, 230, 240 of the rotating fans 21, 23 or the fixed fans 22, 24 to an entire diameter D2 of the rotating fans 21, 23 or the fixed fans 22, 24 may be in a range of 0.4 to 0.8.

A width W1 of the first rotating fan 21 and a width W2 of the second rotating fan 23 may be the same as each other. A width W3 of the first fixed fan 22 and a width W4 of the second fixed fan 24 may be the same as each other. The width W1 of the first rotating fan 21 and the width W2 of the second rotating fan 23 may be greater than the width W3 of the first fixed fan 22 and the width W4 of the second fixed fan 24.

According to one aspect, since the air conditioner 1 is provided with the plurality of rotating fans, a volume of air and wind speed may be greater compared to when a single rotating fan is provided. As a volume of air is increased, cooling efficiency of the air conditioner 1 may be improved.

In addition, as the plurality of rotating fans are disposed in a forward and backward direction based on an air flow direction, an area occupied by the fan assembly 20 in the air conditioner 1 may not be increased. As the area occupied by the fan assembly 20 in the air conditioner 1 is not increased, the air conditioner 1 may be provided in a compact structure.

Although the embodiment in which two rotating fans and two fixed fans are alternately provided has been described above, the numbers of rotating fans and fixed fans are not limited to those described above as long as one or more fixed fans are provided between adjacent rotating fans.

Figure 4:
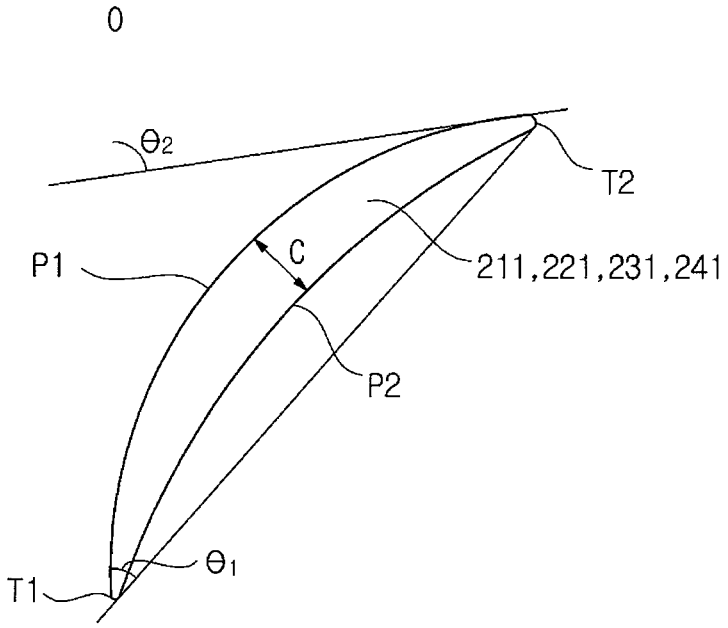
FIG. 4 is a view illustrating a blade according to one embodiment.

FIG. 4 is a view illustrating a blade according to one embodiment.

Referring to FIG. 4, the plurality of blades 211, 221, 231, and 241 provided in the fan assembly 20 according to one embodiment may be provided in an arc fan or airfoil fan shape. In a case of the arc fan shape, one surface P1 and the other surface P2 of the blade are formed as curved surfaces, and a width C of a cross-section of the blade is uniform. In a case of the airfoil fan shape, a shape of the blade may be a streamlined shape, and the width C of the cross-section of the blade may be non-uniform.

A stagger angle θ1 and an inlet angle θ2 of the blades provided at the rotating fans 21, 23 or the fixed fans 22, 24 may be provided in a suitable range. Hereinafter, one blade B of the plurality of blades provided in the rotating fans 21, 23 or the fixed fans 22, 24 will be described. As illustrated in FIGS. 3 and 4, a straight line which vertically passes through the fan assembly 20 may be referred to as a reference line O.

An angle between a straight line which connects one end portion T1 of the blade B to—the other end portion T2 and the reference line O may be referred to as a stagger angle θ1. Resistance of an air flow due to the blade B is decreased according to a decrease of the stagger angle θ1, therefore a volume of air may be increased.

The stagger angle θ1 of the blade 211 provided in the first rotating fan 21 and the blade 231 provided in the second rotating fan 23 may be in a range of 10° to 80°. The stagger angle θ1 of the blade 221 provided in the first fixed fan 22 and the blade 241 provided in the second fixed fan 24 may be in a range of 10° to 50°.

The one end portion T1 of the blade B is connected to a fan frame. When air is blown by the fan assembly 20, the air may be blown to flow from the other end portion T2 of the blade B along a curved surface of the blade B. At this time, an angle between the other end portion T2 of the blade B and the reference line O may be referred to as the inlet angle θ2. The inlet angle θ2 of the blade 221, 241 provided in the fixed fan 22, 24 may be in a range of 10° to 50°.

The ranges of the stagger angle and the inlet angle of the blade provided in the rotating fans 21, 23 and the fixed fans 22, 24 are not limited to those described above.

Figure 5:
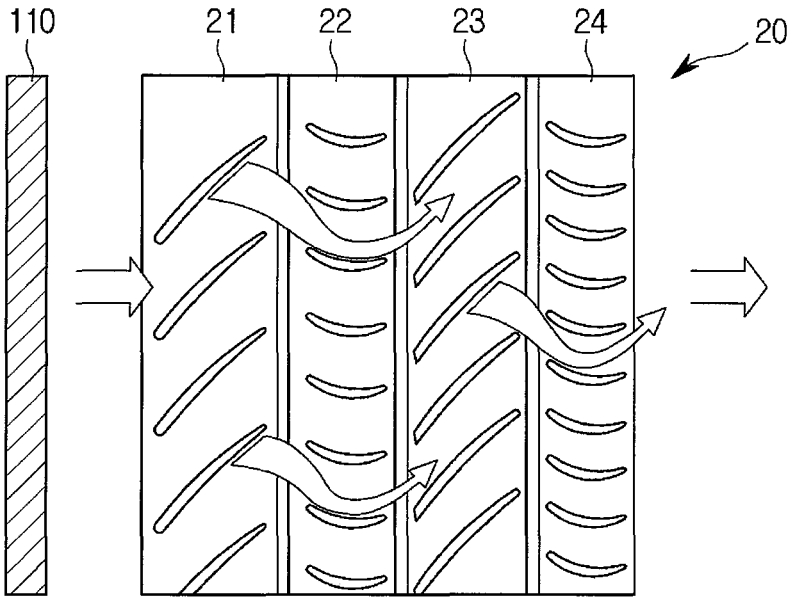
FIG. 5 is a view illustrating a flow path of the fan assembly according to one embodiment.

FIG. 5 is a view illustrating a flow path of the fan assembly according to one embodiment.

Referring to FIG. 5, in the fan assembly 20 according to one embodiment, air which has passed through the heat exchanger 110 may be blown by the first rotating fan 21 and the second rotating fan 23 to be discharged into the indoor area through the discharge port 100.

Air which has passed through the heat exchanger 110 first passes through the first rotating fan 21. As air is blown by the first rotating fan 21 rotating, a pressure of the air which has passed through the first rotating fan 21 may be increased. A flow direction of the air which has passed through the first rotating fan 21 may be guided while passing through the first fixed fan 22. The direction of an air flow path which has passed through the first rotating fan 21 may be adjusted by the first fixed fan 22, and the air may be transferred to the second rotating fan 23 without flow loss. The air guided by the first fixed fan 22 may be blown by the second rotating fan 23, therefore a pressure of the air may be further increased. The flow path of the air which has passed through the second rotating fan 23 may be guided by the second fixed fan 24. The air which has passed through the second fixed fan 24 may be discharged into the indoor area through the discharge port 100.

As described above, air which has passed through the heat exchanger 110 may receive greater energy compared to when being blown by a single rotating fan and may be blown. Air blown by the plurality of rotating fans 21, 23 may be blown in a greater volume. The first fixed fan 22 is provided between the first rotating fan 21 and the second rotating fan 23 to prevent pressure loss in air moving from the first rotating fan 21 to the second rotating fan 23. Air which has passed through the second rotating fan 23 may be discharged through the discharge port 100 by the second fixed fan 24 without pressure loss.

Figure 6:
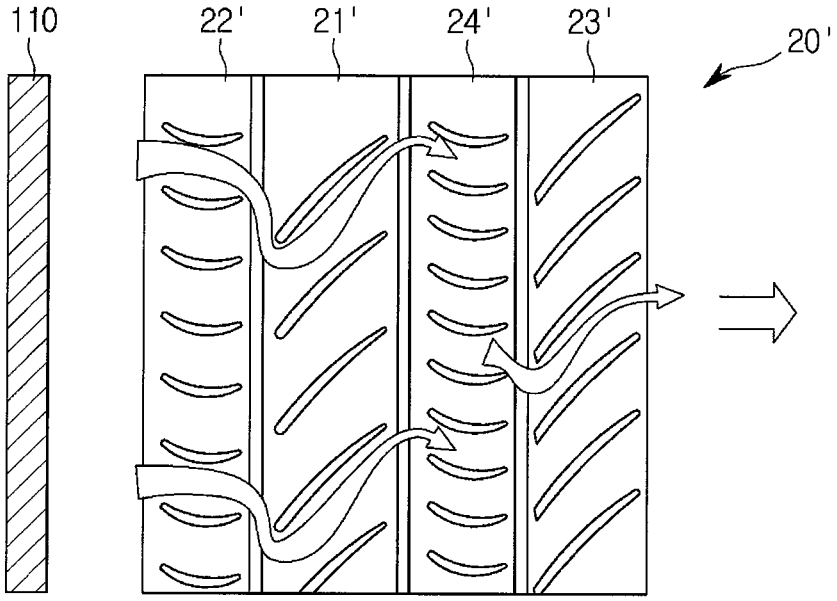
FIG. 6 is a view illustrating a flow path of a fan assembly according to another embodiment.

FIG. 6 is a view illustrating a flow path of a fan assembly according to another embodiment.

Referring to FIG. 6, a fan assembly 20' according to another embodiment may be provided so that air which has passed through the heat exchanger 110 first passes through a first fixed fan 22'. A first rotating fan 21' may be positioned in front of the first fixed fan 22', and a second fixed fan 24' may be provided in front of the first rotating fan 21'. A second rotating fan 23' may be provided in front of the second fixed fan 24'. Air which has passed through the heat exchanger 110 sequentially passes through the first fixed fan 22', the first rotating fan 21', the second fixed fan 24', and the second rotating fan 23', the air may be discharged through a discharge port 100.

The air which has passed through the first fixed fan 22' receives energy from the first rotating fan 21', and therefore, a pressure thereof is increased. The air which has passed through the first rotating fan 21' may be guided toward the second rotating fan 23' by the second fixed fan 24' without pressure loss. A pressure of the air which has passed through the second fixed fan 24' is increased at the second rotating fan 23' and the air may be discharged into an indoor area through the discharge port 100.

As described above, when the plurality of rotating fans and one or more fixed fans are provided, as illustrated in FIG. 5, after air which has passed through the heat exchanger first passes through a rotating fan, the air may sequentially pass through a fixed fan and a rotating fan, and as illustrated in FIG. 6, after air first passes through a fixed fan, the air may sequentially pass through a rotating fan, a fixed fan, and a rotating fan.

According to one aspect, the fan assembly may include a plurality of rotating fans and one or more fixed fans, and the fixed fan may be positioned between adjacent rotating fans. As the fixed fan is provided between the adjacent rotating fans, air which has passed through one rotating fan may be transferred to another rotating fan without pressure loss. Therefore, a volume of air of the fan assembly may be increased by the plurality of rotating fans without pressure loss.

Figure 7:
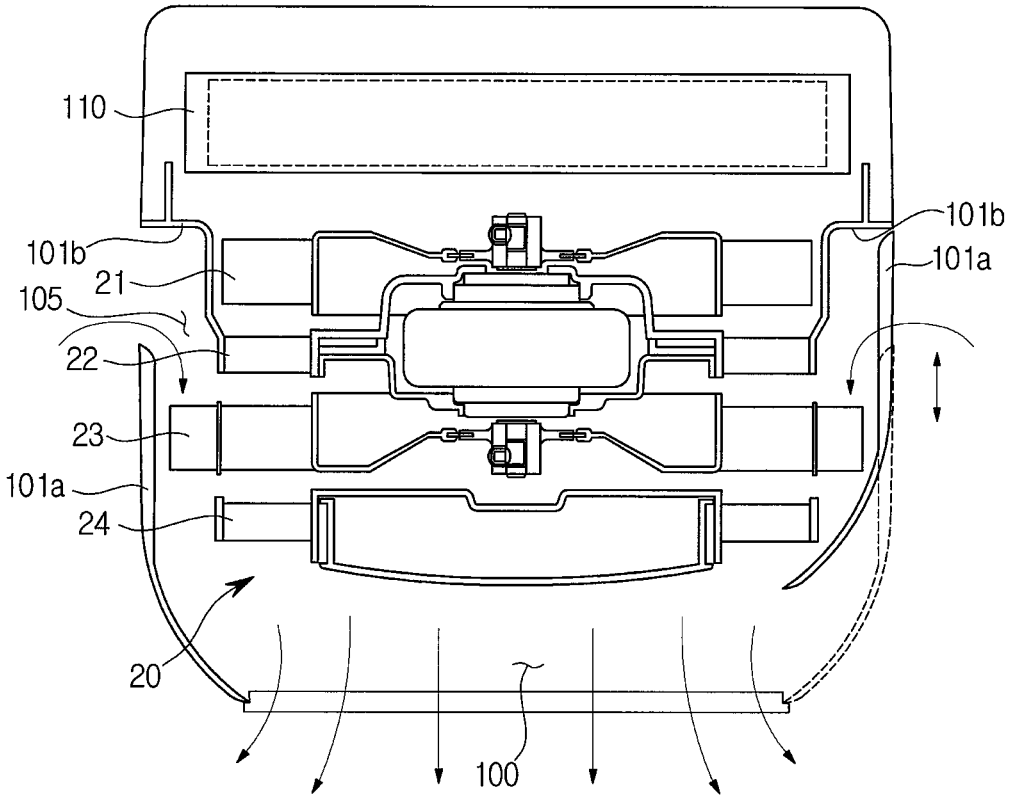
FIG. 7 is a view illustrating a part of the indoor unit provided with the fan assembly according to one embodiment.

FIG. 7 is a view illustrating a part of the indoor unit provided with the fan assembly according to one embodiment.

Referring to FIG. 7, one side surfaces of the housings 101, 102 of the indoor unit 10 according to one embodiment may be provided capable of opening and closing. A portion of the housings 101, 102 positioned at one side of the fan assembly 20 may be provided to be open to form an air inlet portion 105. When the indoor unit 10 is operated, air which has been introduced into the indoor unit 10 through the air inlet portion 105 may be blown together with air which has passed through the heat exchanger 110 by the fan assembly 20 and may be discharged into the indoor area through the discharge port 100.

For example, a part of the front panel 101 may include a first front panel 101*a* and a second front panel 101*b*. The first front panel 101*a* may be provided to be spaced apart from the second front panel 101*b* by moving forward. When the first front panel 101*a* is spaced apart from the second front panel 101*b* by moving forward, the air inlet portion 105 through which air may be introduced into the indoor unit 10 in which the fan assembly 20 is positioned may be formed between the first front panel 101*a* and the second front panel 101*b*.

When the fan assembly 20 includes the first rotating fan 21 and the second rotating fan 23, air which has been introduced through the air inlet portion 105 may pass through only the second rotating fan 23. Air which has passed through the heat exchanger 110 may pass through the first rotating fan 21 and the first fixed fan 22, and flow to the second rotating fan 23, and the second rotating fan 23 may blow the air which has passed through the first fixed fan 22 together with the air which introduced through the air inlet portion 105.

The first front panel 101*a* may be moved forward by a user's operation. When the indoor unit 10 is operated, the first front panel 101*a* may also be provided to be spaced apart from the second front panel 101*b* by automatically moving forward.

Air which has passed through the heat exchanger 110 together with air which has been introduced through one side surface of the housing may be blown by the fan assembly 20. As described above, as air which has been introduced through one side of the housing is blown with air which has passed through the heat exchanger 110, a volume of air from the fan assembly 20 may be further increased.

Figure 8:
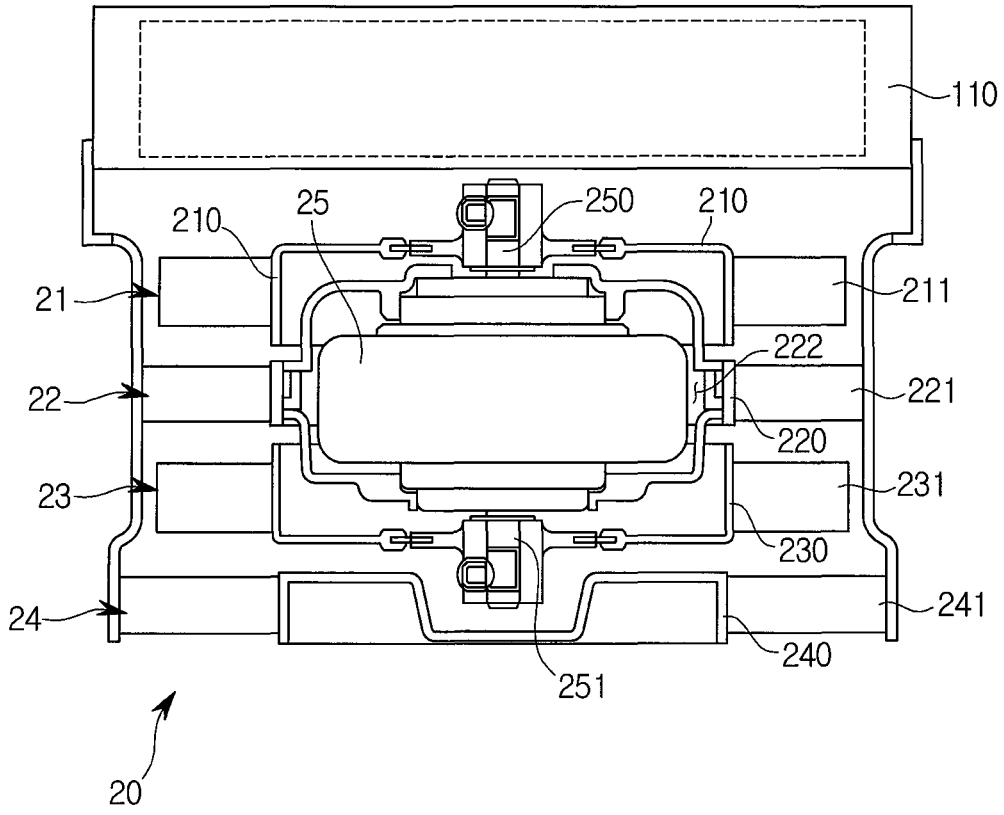
FIG. 8 is a view illustrating the fan assembly provided with a fan motor according to one embodiment.

FIG. 8 is a view illustrating the fan assembly provided with a fan motor according to one embodiment.

Referring to FIG. 8, the fan assembly 20 according to one embodiment may be sequentially provided with the first rotating fan 21, the first fixed fan 22, the second rotating fan 23, and the second fixed fan 24. The first rotating fan 21 and the second rotating fan 23 may be rotated by the fan motor 25. A single fan motor 25 may be provided.

The fan motor 25 may be provided with a first rotating shaft 250 and a second rotating shaft 251. The first rotating fan 21 may be installed at the first rotating shaft 250, and the second rotating fan 23 may be installed at the second rotating shaft 251. As the first rotating shaft 250 and the second rotating shaft 251 are rotated by the fan motor 25, the first rotating fan 21 and the second rotating fan 23 may be rotated.

The fan motor 25 may be installed at the first fixed fan 22. An accommodation portion 222 in which the fan motor 25 is accommodatable may be provided in the fan frame 220 of the first fixed fan 22. As the fan motor 25 is provided to be accommodated in the accommodation portion 222 of the first fixed fan 22, a volume occupied by the fan assembly 20 may be decreased as compared to when a separate space for the fan motor 25 is provided.

Since the first rotating fan 21 and the second rotating fan 23 are rotated by the single fan motor 25, the first rotating fan 21 and the second rotating fan 23 may be rotated at the same speed. In addition, on or off operations of the first rotating fan 21 and the second rotating fan 23 may be performed at the same time.

Figure 9:
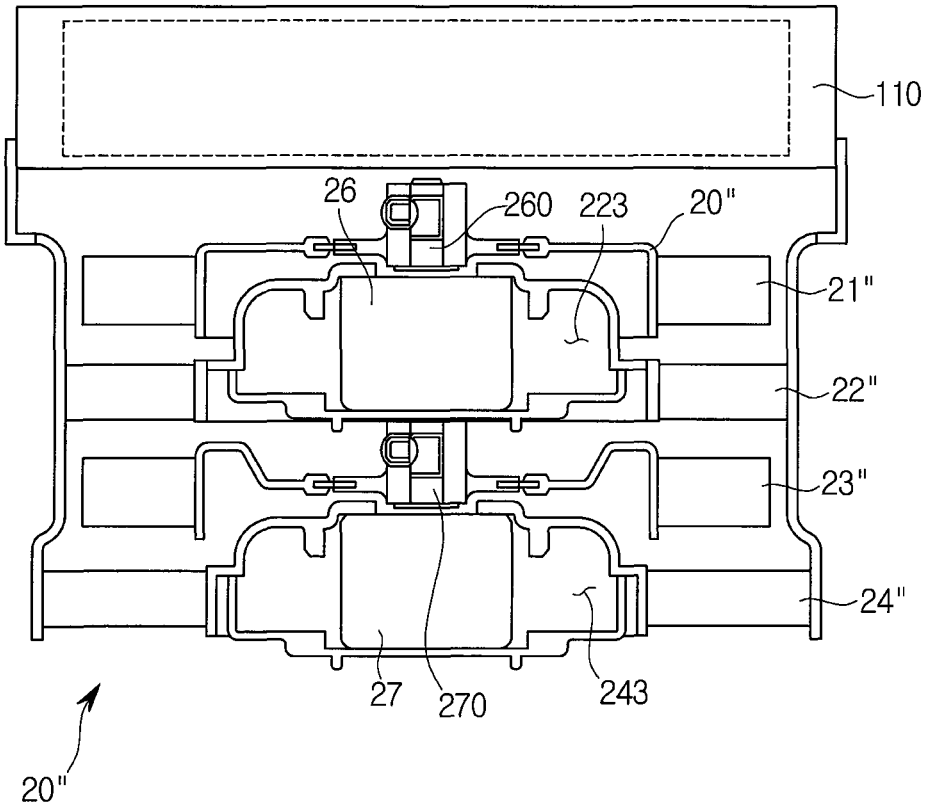
FIG. 9 is a view illustrating a fan assembly provided with a fan motor according to another embodiment.

FIG. 9 is a view illustrating a fan assembly provided with a fan motor according to another embodiment.

Referring to FIG. 9, a fan assembly 20" according to another embodiment may be sequentially provided with a first rotating fan 21", a first fixed fan 22", a second rotating fan 23", and a second fixed fan 24". The first rotating fan 21" and the second rotating fan 23" may be respectively driven by separately provided fan motors 26, 27.

The fan motors 26, 27 may include the first fan motor 26 which drives the first rotating fan 21" and the second fan motor 27 which drives the second rotating fan 23". The first fan motor 26 may include a first rotating shaft 260 connected to the first rotating fan 21", and the second fan motor 27 may include a second rotating shaft 270 connected to the second rotating fan 23".

The first fan motor 26 is accommodated in an accommodation portion 223 provided at the first fixed fan 22", and the second fan motor 27 may be accommodated in an accommodation portion 243 provided at the second fixed fan 24". As described above, as the first fan motor 26 and the second fan motor 27 are respectively accommodated in the accommodation portions 223, 243 provided at the first fixed fan 22" and the second fixed fan 24", a volume occupied by the fan assembly 20" may be decreased as compared to when a separate space for the fan motor is provided.

The first fan motor 26 and the second fan motor 27 are respectively provided to independently drive the first rotating fan 21" and the second rotating fan 23". Therefore, the first rotating fan 21" and the second rotating fan 23" may be rotated at different speeds. In some cases, only any one of the first rotating fan 21" or the second rotating fan 23" may be rotated. In addition, in some cases, the first rotating fan 21" and the second rotating fan 23" may also be rotated in opposite directions. On or off operations of the first rotating fan 21" and the second rotating fan 23" may be independently performed.

Figure 10:
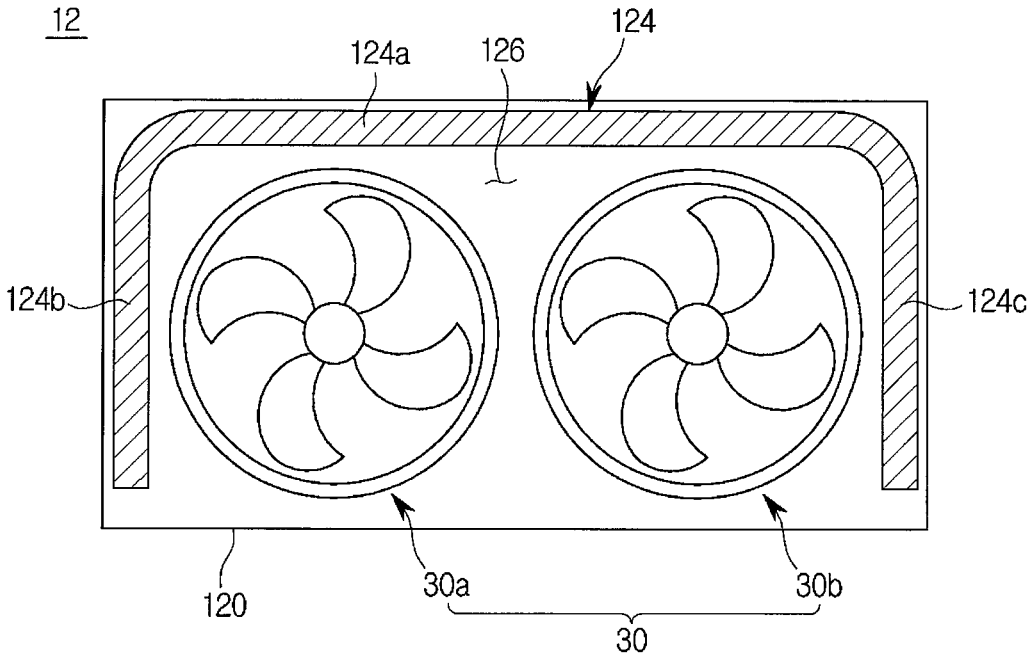
FIG. 10 is a top view illustrating an outdoor unit provided with a heat exchanger according to one embodiment.
Figure 11:
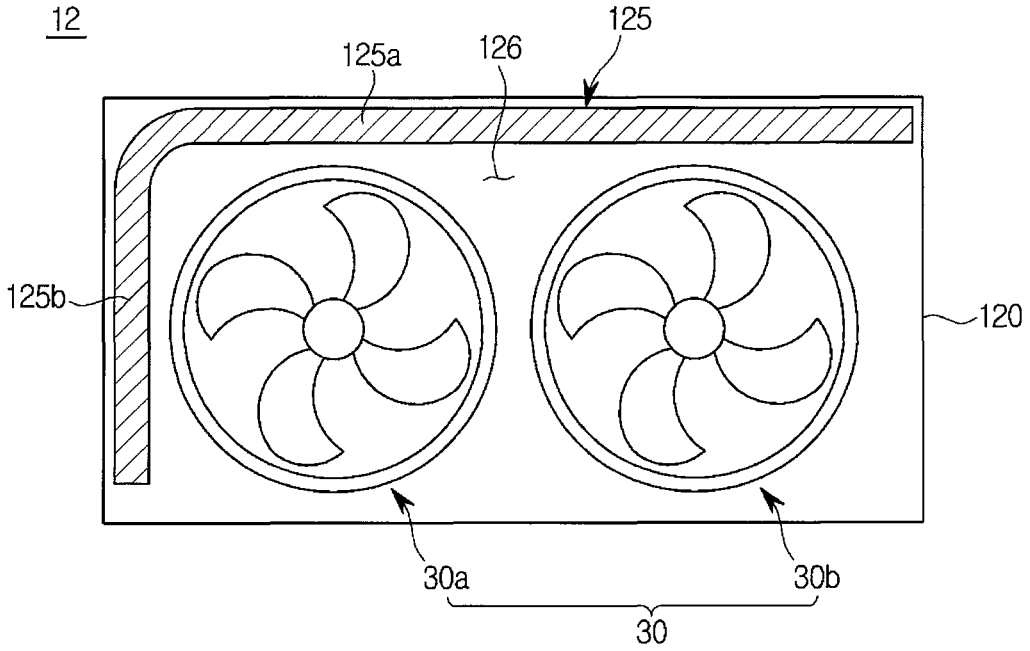
FIG. 11 is a top view illustrating an outdoor unit provided with a heat exchanger according to another embodiment.

FIG. 10 is a top view illustrating an outdoor unit provided with a heat exchanger according to one embodiment, and FIG. 11 is a top view illustrating an outdoor unit provided with a heat exchanger according to another embodiment.

Referring to FIGS. 10 and 11, the outdoor unit 12 according to one embodiment includes a fan assembly 30 which blows air of an accommodation portion 126 of the outdoor unit 12 to the outside. Here, the accommodation portion 126 refers to an inner space of the outdoor unit 12 formed by heat exchangers 124, 125. The fan assembly 30 may be positioned at an upper space of the accommodation portion 126.

A plurality of fan assemblies 30 may be provided. For example, the fan assembly 30 may include a first fan assembly 30*a* and a second fan assembly 30*b*. The first fan assembly 30*a* and the second fan assembly 30*b* may be positioned at an upper space of the outdoor unit 12. The fan assembly 30 may also be provided at a side surface of the outdoor unit 12.

The numbers and the positions of the fan assemblies 30 are not limited to those described above. Hereinafter, the embodiment in which the fan assembly 30 includes the first fan assembly 30*a* and the second fan assembly 30*b*, and is positioned at the upper space of the outdoor unit 12 will be described.

The outdoor unit 12 may include the heat exchangers 124, 125. The heat exchangers 124, 125 may be provided in various shapes. The heat exchanger 124 may be provided in the outdoor unit 12. As illustrated in FIG. 10, the heat exchanger 124 may include a first heat exchanger 124*a* positioned at one surface of a side panel 120, a second heat exchanger 124*b* positioned at a side of one end portion of the first heat exchanger 124*a*, and a third heat exchanger 124*c* positioned at a side of the other end portion of the first heat exchanger 124*a*. The first heat exchanger 124*a*, the second heat exchanger 124*b*, and the third heat exchanger 124*c* may be respectively provided at adjacent inner surfaces of the side panel 120. The first heat exchanger 124*a*, the second heat exchanger 124*b*, and the third heat exchanger 124*c* may be provided by one heat exchanger 124 being bent, or the first heat exchanger 124*a*, the second heat exchanger 124*b*, and the third heat exchanger 124*c* may be separately provided.

As illustrated in FIG. 11, the heat exchanger 125 may include a first heat exchanger 125*a* positioned at one surface of the side panel 120, and a second heat exchanger 125*b* positioned at another surface of the side panel 120. The first heat exchanger 125*a* and the second heat exchanger 125*b* may be provided as one connected heat exchanger 125, or may be separately provided and accommodated at the side panel 120. In FIG. 11, although the embodiment in which the first heat exchanger 125*a* and the second heat exchanger 125*b* are positioned at adjacent inner surfaces of the side panel 120 is illustrated, the first heat exchanger 125*a* and the second heat exchanger 125*b* may also be respectively provided at facing inner surfaces of the side panel 120.

The shapes and the positions of the heat exchangers 124, 125 are not limited to those described above. Various shapes of the heat exchangers 124, 125 may be provided according to a condition of the outdoor unit 12.

Referring to FIGS. 1, 10, and 11, a high temperature refrigerant that has exchanged heat in the indoor unit 10 may move to the outdoor unit 12 through a refrigerant pipe 13*a*, and may be cooled by exchanging heat with air in the heat exchangers 124, 125 of the outdoor unit 12. The refrigerant which has been cooled in the outdoor unit 12 may again move to indoor unit 10 through a refrigerant pipe 13*b*.

The outdoor unit 12 may be provided with the fan assembly 30 to discharge air that has exchanged heat in the heat exchangers 124, 125 to an outside of the outdoor unit 12. Air which has been introduced into the outdoor unit 12 through the inlet port 121 by the fan assembly 30 may be discharged to the outside of the outdoor unit 12 through the outlet port 123.

Figure 12:
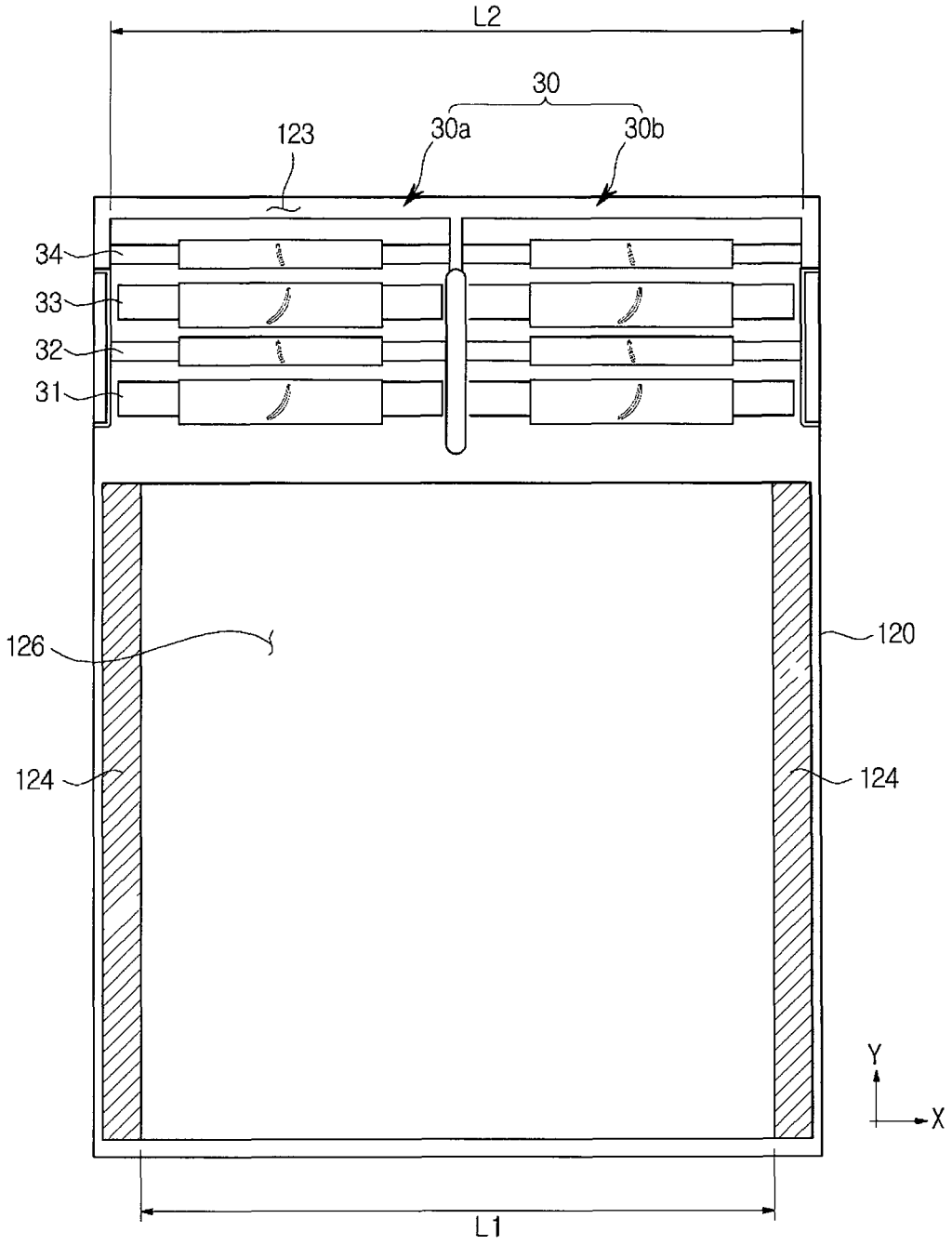
FIG. 12 is a side view illustrating the outdoor unit according to one embodiment.

FIG. 12 is a side view illustrating the outdoor unit according to one embodiment.

Referring to FIG. 12, the fan assembly 30 according to one embodiment may be positioned at an upper portion of the heat exchanger 124. The heat exchanger 124 may be positioned adjacent to a side panel 120 of the outdoor unit 12. The fan assembly 30 may include the first fan assembly 30*a* and the second fan assembly 30*b*. The first fan assembly 30*a* and the second fan assembly 30*b* may be adjacently disposed in a row.

A length L2 in an X axis direction of the first fan assembly 30*a* and the second fan assembly 30*b* disposed in a row may be greater than an inner diameter L1 in the X axis direction of an inner space 126 of the housing 120 in which the heat exchanger 124 is positioned. When the heat exchanger 124 is provided between both facing side surfaces of the housing 120 of the outdoor unit 12, the inner diameter L1 in the X axis direction of the housing 120 may be a distance between facing inner surfaces of the heat exchanger 124. When the heat exchanger is provided at only any one side surface of the housing 120, an inner diameter in the X axis direction of the housing 120 may be a distance between an inner surface of the heat exchanger and an inner surface of the housing 120 facing the inner surface of the heat exchanger. Since the length L2 in the X axis direction of the first fan assembly 30*a* and the second fan assembly 30*b* is greater than the inner diameter L1 in the X axis direction of the accommodation portion 126 of the housing 120 in which the heat exchanger 124 is positioned, the fan assembly 30 may be positioned above the heat exchanger 124.

The first fan assembly 30*a* and the second fan assembly 30*b* may include a plurality of rotating fans and one or more fixed fans. The fixed fan may be positioned between the adjacent rotating fans. Since a configuration of the second fan assembly 30*b* may be similar to that of the first fan assembly 30*a*, hereinafter, the configuration of the first fan assembly 30*a* will be described.

For example, the first fan assembly 30*a* may include two rotating fans 31, 33 and two fixed fans 32, 34. The rotating fans 31, 33 may include the first rotating fan 31 and the second rotating fan 33. The fixed fans 32, 34 may include the first fixed fan 32 and the second fixed fan 34. The first rotating fan 31, the first fixed fan 32, the second rotating fan 33, and the second fixed fan 34 may be sequentially disposed from the heat exchanger 124 of the outdoor unit 12. The second fixed fan 34 may be disposed adjacent to the outlet port 123. In some cases, the second fixed fan 34 may be omitted.

The description of the fan assembly 20 provided in the indoor unit 10 illustrated in FIGS. 2 to 9 may be similarly applied to the fan assembly 30 provided in the outdoor unit 12. Therefore, description of the configuration of the fan assembly 30 provided in the outdoor unit 12 overlapping that of the fan assembly 20 provided in the indoor unit 10 will be omitted. The fan assembly 30 provided in the outdoor unit 12 is similar to the fan assembly provided in the indoor unit in a viewpoint that an volume of air of the fan assembly may be increased by a plurality of rotating fans, and an air flow may be guided by the fixed fan positioned between the adjacent rotating fans without pressure loss.

Figure 13:
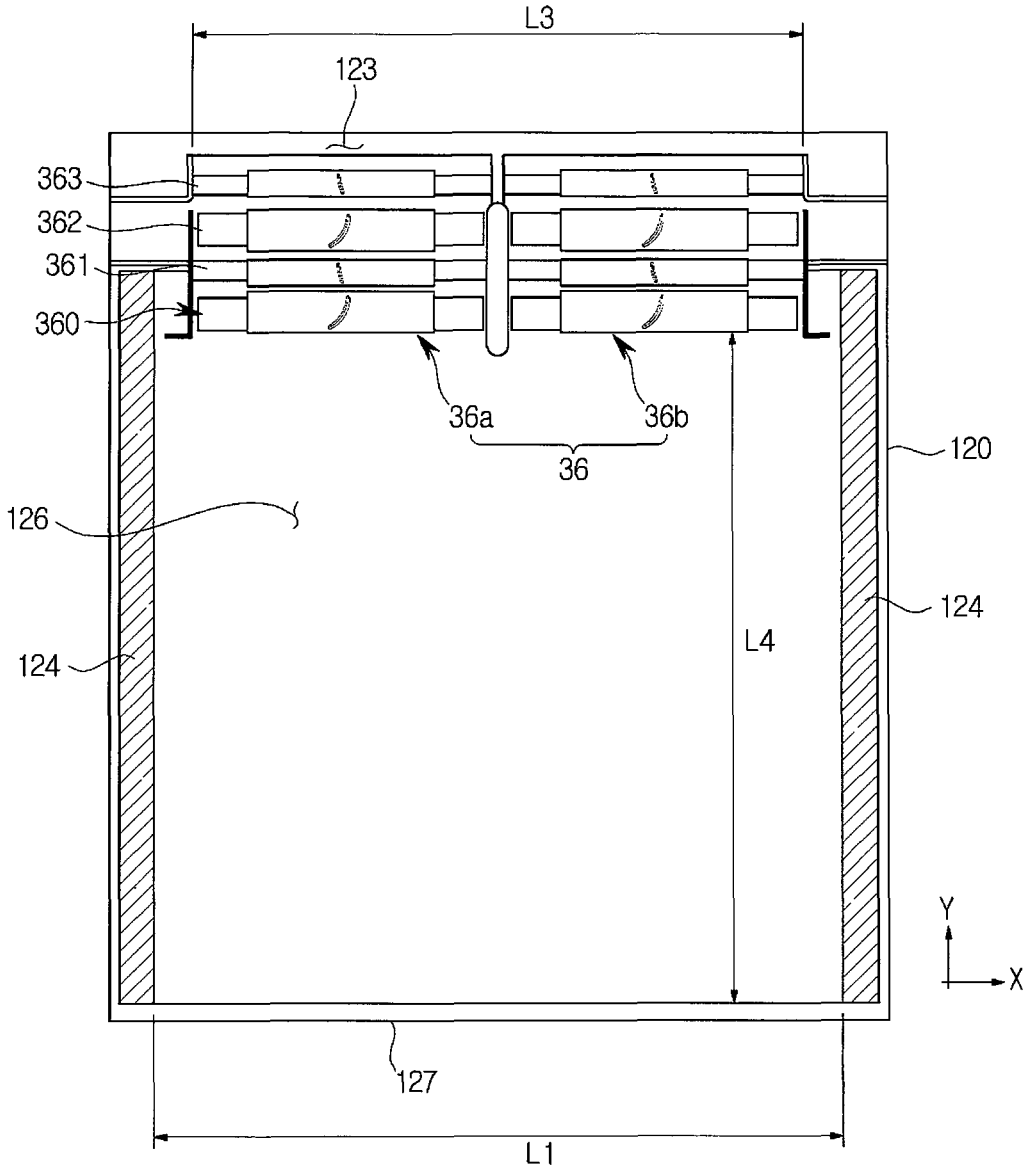
FIG. 13 is a side view illustrating the outdoor unit according to another embodiment.

FIG. 13 is a side view illustrating the outdoor unit according to another embodiment.

Referring to FIG. 13, a part of a fan assembly 36 provided in an outdoor unit 12 according to another embodiment may be positioned at an accommodation portion 126 of a housing 120 in which a heat exchanger 124 is provided. An entire diameter L3 in an X axis direction of the fan assembly 36 may be less than a diameter L1 in the X axis of the accommodation portion 126 of the housing 120.

The fan assembly 36, similar to the fan assembly 30 illustrated in FIG. 12, may include a first fan assembly 36*a* and a second fan assembly 36*b*. Each of the first fan assembly 36*a* and the second fan assembly 36*b* may include two rotating fans and two fixed fans. One or more fixed fans may be positioned between the adjacent rotating fans.

In the first fan assembly 36*a*, a first rotating fan 360, a first fixed fan 361, a second rotating fan 362, and a second fixed fan 363 may be sequentially positioned from the heat exchanger 124 toward the outlet port 123. In some cases, the second fixed fan 363 may be omitted.

At least a part of the first fan assembly 36*a* may be positioned in the accommodation portion 126 of the outdoor unit 12 in which the heat exchanger 124 is positioned. Specifically, at least one of the rotating fans of the first fan assembly 36*a* may be positioned in the accommodation portion 126. For example, the first rotating fan 360 may be positioned in the accommodation portion 126 of the outdoor unit 12. The first rotating fan 360 and the first fixed fan 361 may also be positioned in the accommodation portion 126, and the entire first fan assembly 36*a* may also be positioned in the accommodation portion 126.

As described above, as at least one rotating fan of the first fan assembly 36*a* is positioned in the accommodation portion 126, a distance between the rotating fan and a bottom panel 127 of the outdoor unit 12 may be decreased. As the distance between the rotating fan and the bottom panel 127 is decreased, a suction force from the rotating fan may also be transferred to air accommodated at a side of the bottom panel 127. Therefore, air that has exchanged heat in the outdoor unit 12 may be efficiently discharged through the outlet port 123. The description of the configuration and the position of the first fan assembly 36*a* may be similarly applied to the second fan assembly 36*b*.

In the above description, although the embodiment including the fan assembly includes the first rotating fan, the second rotating fan, the first fixed fan, and the second fixed fan was described, the numbers and positions of the rotating fans and the fixed fans are not limited to those described above. For example, a fixed fan may also be further provided in front of the first rotating fan.

As is apparent from the above description, the cooling and heating performance of the air conditioner can be improved.

In addition, loss due to a fan assembly can be prevented.

In addition, the fan assembly can be formed to be compact, thereby preventing the volume increase of the air conditioner.

The above-described detail descriptions are only examples of the present disclosure. In addition, the above-described descriptions have described exemplary embodiments of the present disclosure, and the present disclosure may be used in various combinations, modifications, and environments. That is, the present disclosure may be changed and modified in a range of the concept and in an equivalent range of the content of the invention disclosed in the present specification and/or technology or knowledge in the art. The described embodiments describe the best state for implementing the concept of the present disclosure, and various modifications required for applying the present disclosure to specific fields and uses may be possible. Accordingly, the above-described detailed description of the present disclosure does not limit the present disclosure to the embodiments disclosed. In addition, the appended claims should be interpreted to include other embodiments.

What is claimed is:

1. A plurality of fan assemblies provided in a housing of an indoor unit of an air conditioner, each fan assembly of the plurality of fan assemblies comprising:

a plurality of rotating fans provided to be rotatable about a same rotating shaft; and at least one fixed fan fixed between adjacent two rotating fans of the plurality of rotating fans, wherein each rotating fan of the plurality of rotating fans and the at least one fixed fan includes a fan frame and a plurality of blades which radially extend from the respective fan frame, wherein stagger angles of each of the plurality of blades of each rotating fan of the plurality of rotating fans are different from a stagger angle of the plurality of blades of the at least one fixed fan, and wherein a length of the plurality of fan assemblies is greater than an inner diameter of the housing.

2. The plurality of fan assemblies of claim 1, wherein the plurality of rotating fans of each fan assembly is provided to simultaneously rotate at a same speed.

3. The plurality of fan assemblies of claim 2, wherein the plurality of rotating fans of each fan assembly receives a driving force from a single fan motor.

4. The plurality of fan assemblies of claim 3, wherein an accommodation portion in which the single fan motor is accommodated is provided in the at least one fixed fan of each fan assembly.

5. The plurality of fan assemblies of claim 1, wherein the plurality of rotating fans of each fan assembly is controlled to be separately turned on or off.

6. The plurality of fan assemblies of claim 5, wherein the plurality of rotating fans of each fan assembly is controlled to rotate at different speeds from each other.

7. The plurality of fan assemblies of claim 5, wherein the plurality of rotating fans of each fan assembly respectively receives driving forces from fan motors that are separately provided from each other.

8. The plurality of fan assemblies of claim 1, wherein:

each fan assembly of the plurality of fan assemblies further includes a fan motor which drives the plurality of rotating fans, and the fan motor is installed in the fan frame of the at least one fixed fan of each fan assembly.

9. The plurality of fan assemblies of claim 1, wherein the stagger angles of the plurality of blades provided in each rotating fan of the plurality of rotating fans of each fan assembly are in a range of 10° to 80°.

10. The plurality of fan assemblies of claim 1, wherein the stagger angle of the plurality of blades provided in the at least one fixed fan of each fan assembly is in a range of 10° to 50°.

11. The plurality of fan assemblies of claim 1, wherein an inlet angle of the plurality of blades provided in the at least one fixed fan of each fan assembly is in a range of 10° to 50°.

12. The plurality of fan assemblies of claim 1, wherein the plurality of blades provided in each rotating fan of the plurality of rotating fans of each fan assembly, or the plurality of blades in the at least one fixed fan of each fan assembly, is provided in an arc fan shape.

13. The plurality of fan assemblies of claim 1, wherein the plurality of blades provided in each rotating fan of the plurality of rotating fans of each fan assembly, or the plurality of blades in the at least one fixed fan of each fan assembly, is provided in an airfoil fan shape.

14. The plurality of fan assemblies of claim 1, wherein a ratio (D1/D2) of a diameter (D1) of the fan frame provided in at least one of the plurality of rotating fans of each fan assembly, or the at least one fixed fan of each fan assembly, to an entire diameter (D2) of at least one of the plurality of rotating fans of each fan assembly, or the at least one fixed fan of each fan assembly, is in a range of 0.4 to 0.8.

15. The plurality of fan assemblies of claim 1, wherein the plurality of rotating fans of each fan assembly includes a first rotating fan and a second rotating fan, and the at least one fixed fan of each fan assembly includes a first fixed fan and a second fixed fan.

16. The plurality of fan assemblies of claim 15, wherein the plurality of rotating fans of each fan assembly and the at least one fixed fan of each fan assembly are disposed in an order of the first rotating fan, the first fixed fan, the second rotating fan and the second fixed fan.

17. The plurality of fan assemblies of claim 16, wherein the first rotating fan is positioned at a side of an air inlet portion, and the second fixed fan is positioned at a side of an air outlet portion.

18. The plurality of fan assemblies of claim 15, wherein the plurality of rotating fans of each fan assembly and the at least one fixed fan of each fan assembly are disposed in an order of the first fixed fan, the first rotating fan, the second fixed fan, and the second rotating fan.

19. An air conditioner comprising:

a housing which forms an exterior of an indoor unit and in which a discharge port is formed so that air that has exchanged heat with a refrigerant is discharged; and a plurality of fan assemblies which is accommodated in the housing and blows air into an indoor area, wherein a length of the plurality of fan assemblies is greater than an inner diameter of the housing, wherein each fan assembly of the plurality of fan assemblies includes a plurality of rotating fans provided to be rotatable about a same rotating shaft and at least one fixed fan fixed between two adjacent rotating fans of the plurality of rotating fans, wherein each rotating fan of the plurality of rotating fans of each fan assembly and the at least one fixed fan of each fan assembly includes a fan frame and a plurality of blades which radially extend from the respective fan frame, and wherein stagger angles of each of the plurality of blades of each rotating fan of the plurality of rotating fans of each fan assembly are different from a stagger angle of the at least one fixed fan of each fan assembly.

* * * * *